US011247098B2

(12) United States Patent
Gwon

(10) Patent No.: US 11,247,098 B2
(45) Date of Patent: Feb. 15, 2022

(54) RESPIRATORY REHABILITATION APPARATUS

(71) Applicant: GH Innotek Co., Ltd., Busan (KR)

(72) Inventor: Yu Hong Gwon, Busan (KR)

(73) Assignee: GH Innotek Co., Ltd., Busan (KR)

( * ) Notice: Subject to any disclaimer, the term of this patent is extended or adjusted under 35 U.S.C. 154(b) by 255 days.

(21) Appl. No.: 16/605,270

(22) PCT Filed: Oct. 22, 2018

(86) PCT No.: PCT/KR2018/012464
§ 371 (c)(1),
(2) Date: Oct. 15, 2019

(87) PCT Pub. No.: WO2020/067600
PCT Pub. Date: Apr. 2, 2020

(65) Prior Publication Data

US 2021/0331035 A1 Oct. 28, 2021

(30) Foreign Application Priority Data

Sep. 28, 2018 (KR) ..... 10-2018-0116087

(51) Int. Cl.
*A63B 23/18* (2006.01)
*A63B 21/02* (2006.01)
*A63B 21/04* (2006.01)

(52) U.S. Cl.
CPC ..... *A63B 23/18* (2013.01); *A63B 21/02* (2013.01); *A63B 21/022* (2015.10); *A63B 21/0407* (2013.01); *A63B 21/0428* (2013.01)

(58) Field of Classification Search
CPC ..... A63B 23/18; A63B 23/03; A63B 23/032; A63B 21/02; A63B 21/022; A63B 21/0428; A63B 21/0407; A61M 16/00; A61M 16/10; A61M 16/20–201; A61M 16/206–209
See application file for complete search history.

(56) References Cited

U.S. PATENT DOCUMENTS 1,392,700 A * 10/1921 Oyen ..... A63B 23/18 482/13
4,054,134 A * 10/1977 Kritzer ..... A61M 16/00 128/205.24
4,226,233 A * 10/1980 Kritzer ..... A63B 23/18 128/204.18
4,770,413 A * 9/1988 Green ..... A63B 23/18 137/269.5

(Continued)

*Primary Examiner* — Garrett K Atkinson
*Assistant Examiner* — Kathleen M Fisk
(74) *Attorney, Agent, or Firm* — Paratus Law Group, PLLC

(57) ABSTRACT

A respiratory rehabilitation apparatus includes a housing, an adjustment rod provided in the housing to change a pressure load generated during respiration, a pair of stoppers for selectively adjusting respiration pressure, a pair of pressurization-movement parts configured to be pressurized and moved inwards in a longitudinal direction of the housing by respiration pressure during respiration, a pair of elastic members disposed between the pressurization-movement parts and the stoppers, and a pair of diaphragms disposed so as to be in close contact with outer sides in a longitudinal direction of the pressurization-movement parts.

10 Claims, 6 Drawing Sheets

(56) References Cited

U.S. PATENT DOCUMENTS

| | | | | |
|---|---|---|---|---|
| 4,854,574 | A * | 8/1989 | Larson | A63B 23/18 482/13 |
| 6,510,846 | B1 * | 1/2003 | O'Rourke | A61M 15/0086 128/200.21 |
| 6,539,939 | B2 * | 4/2003 | Rubin | A61M 15/0086 128/200.23 |
| 6,659,100 | B2 * | 12/2003 | O'Rourke | A61M 15/0086 128/200.21 |
| 6,726,598 | B1 * | 4/2004 | Jarvis | A63B 23/18 128/200.24 |
| 6,786,216 | B2 * | 9/2004 | O'Rourke | A61M 15/0086 128/200.21 |
| 10,335,635 | B2 * | 7/2019 | Kezirian | A63B 21/0085 |
| 2014/0150801 | A1 * | 6/2014 | Rusher | A63B 21/0088 128/207.16 |
| 2017/0136205 | A1 * | 5/2017 | Rusher | A63B 23/18 |

* cited by examiner

RESPIRATORY REHABILITATION APPARATUS

TECHNICAL FIELD

The present invention relates to a respiratory rehabilitation apparatus, and more particularly to a respiratory rehabilitation apparatus having improved convenience of use.

BACKGROUND ART

In general, with the development of industry, a lot of pollutants are emitted from factories, automobiles, and the like, and the number of persons who suffer from respiratory diseases such as lung diseases or bronchial diseases due to yellow dust or fine dust containing heavy metals is rapidly increasing every year.

In order to treat these respiratory diseases, patients receive not only medicine treatment but also comprehensive respiratory rehabilitation treatment such as chest physiotherapy and psychotherapy. Here, the respiratory rehabilitation treatment includes postural drainage, breathing exercises, and the like.

Here, the breathing exercises may be greatly helpful in removing secretions from the bronchus, alleviating bronchial spasticity, expanding lung tissues, and increasing lung capacity. In addition, exercise capacity may be increased through improvement of breathing and acquisition of a breathing control method, and consequently physical activity in daily life may be increased.

In particular, breathing exercises are one of the essential treatments necessary to increase alveolar ventilation by correcting a bidirectional breathing pattern, i.e. exhalation and inhalation, and by strengthening a respiratory muscle, and to improve a cough function for discharging secretions from the airway. In addition, many people perform breathing exercises suitable for their physical constitutions and environments regularly or as needed in order to relieve their mind and body even though the breathing exercises are not for the purpose of treating a specific disease.

However, a user needs to purchase an expensive breathing-training apparatus in order to perform the breathing exercises, which is economically burdensome, and it is inconvenient to carry the expensive breathing-training apparatus.

In addition, the conventional breathing-training apparatus has a problem in that it is not capable of individually adjusting the training intensity of exhalation and the training intensity of inhalation when a user performs bidirectional breathing exercises according to the user's health condition or lung capacity.

DISCLOSURE

Technical Problem

Therefore, the present invention has been made in view of the above problems, and it is an object of the present invention to provide a respiratory rehabilitation apparatus having improved convenience of use.

Technical Solution

In accordance with the present invention, the above and other objects can be accomplished by the provision of a respiratory rehabilitation apparatus including a housing defining an external appearance, the housing being formed to have a hollow shape, an adjustment rod including a housing-coupling part disposed at the center portion in a longitudinal direction of the housing, the housing-coupling part including a plurality of through-passages formed therethrough in a longitudinal direction, and a pair of rod body parts provided at opposite sides in a longitudinal direction of the housing-coupling part, the rod body parts including screw threads formed in outer circumferences thereof, a pair of stoppers formed to have a hollow shape so as to be coupled to the outer circumferences of the rod body parts, the stoppers including screw threads formed in inner circumferences thereof, the stoppers being configured to selectively adjust respiration pressure, a pair of pressurization-movement parts including protrusions formed at center portions thereof, the protrusions extending outwards in a longitudinal direction, and a plurality of respiration passages formed therethrough, the respiration passages extending in a longitudinal direction while surrounding the protrusions, the pressurization-movement parts being configured to be pressurized and moved inwards in a longitudinal direction of the housing by respiration pressure during respiration, a pair of elastic members disposed between the pressurization-movement parts and the stoppers so as to be selectively pressed, the elastic members surrounding the outer peripheries of the rod body parts, and a pair of diaphragms including a through-hole formed in center portions thereof to allow the protrusions to be inserted thereinto, the diaphragms being disposed to be in close contact with outer sides in a longitudinal direction of the pressurization-movement parts.

Advantageous Effects

With the above-described structure, the respiratory rehabilitation apparatus according to the present invention provides the following effects.

First, since the respiratory rehabilitation apparatus having two functions is formed in a unitary body, expiratory muscle training and inspiratory muscle training may be successively and naturally realized, the apparatus may be reduced in size and may be easy to carry, the manufacturing costs thereof may be reduced, and consequently the productivity thereof may be improved.

Second, unlike a related art in which an expiratory breathing device and an inspiratory breathing device are provided separately from each other, it is possible to provide a synergistic effect in that a user is capable of successively performing expiratory muscle training and inspiratory muscle training without changing the mounting position of a mouthpiece during the respiratory muscle strengthening exercises.

Third, when the first housing and the second housing are individually rotated, the stoppers may be moved in a longitudinal direction, and thus the intensity of the elastic restoring force of each of the elastic members may be adjusted. As a result, the exhalation pressure strength and the inhalation pressure strength may be individually adjusted, thereby greatly improving convenience of use.

Fourth, the stoppers may be individually moved in the longitudinal direction by rod bodies, which have screw threads formed in outer circumferences thereof, and thus the selective adjustment of the exhalation pressure and the inhalation pressure in consideration of the user's lung capacity or the like may be facilitated, thereby improving convenience of use.

BEST MODE

The best mode of the present invention will be described below in detail with reference to the accompanying drawings.

MODE FOR INVENTION

Hereinafter, a respiratory rehabilitation apparatus according to exemplary embodiments of the present invention will be described in detail with reference to the accompanying drawings.

Figure 1:
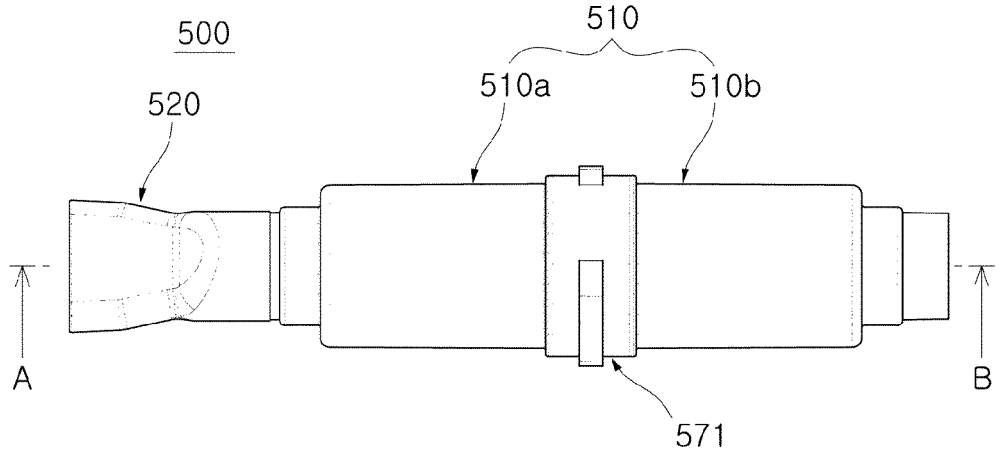
FIG. 1 is a perspective view showing a respiratory rehabilitation apparatus according to an embodiment of the present invention.
Figure 2:
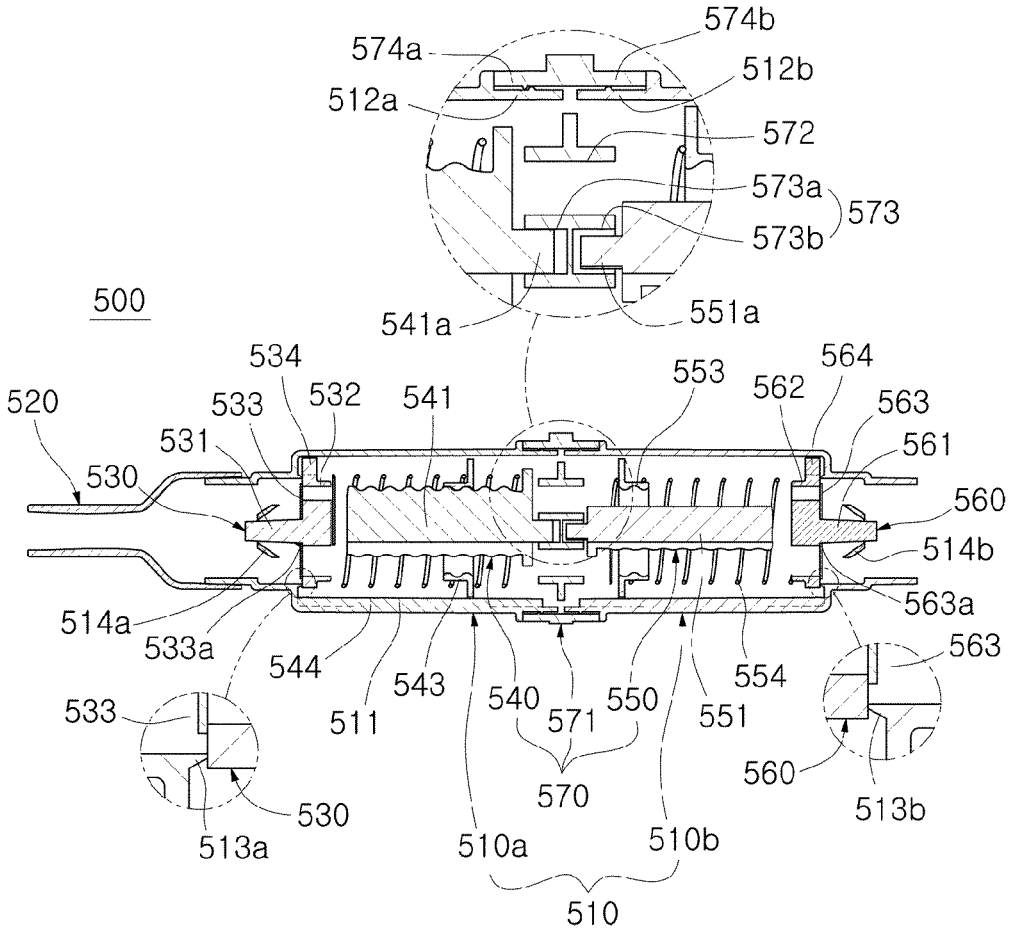
FIG. 2 is a cross-sectional view taken along line A-B in FIG. 1.
Figure 3:
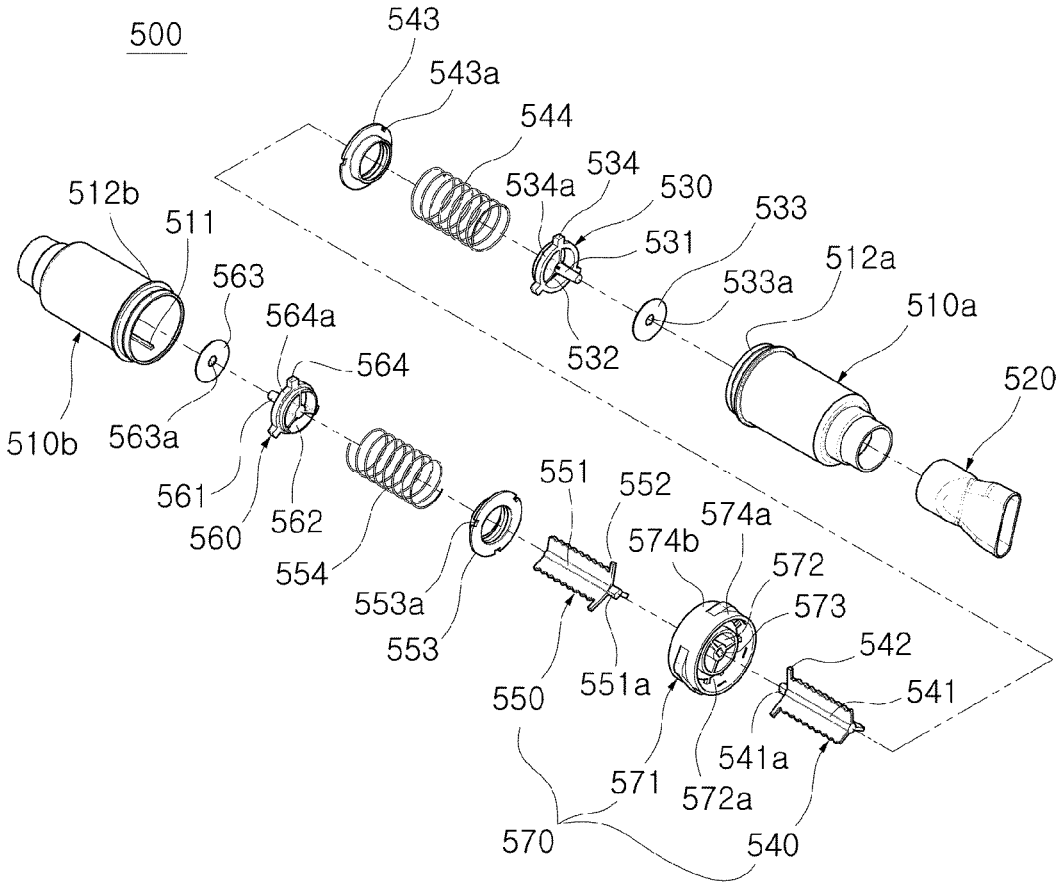
FIG. 3 is an exploded perspective view showing the respiratory rehabilitation apparatus according to the embodiment of the present invention.
Figure 4:
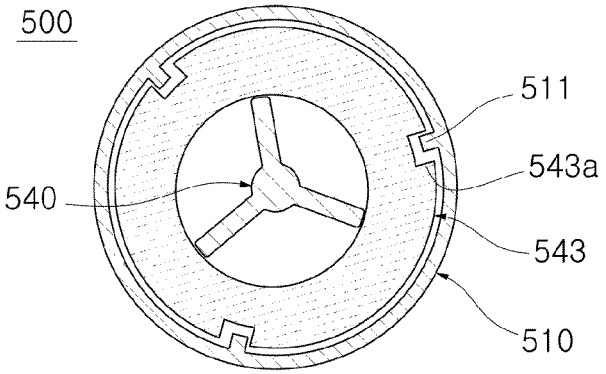
FIG. 4 is a cross-sectional view of the respiratory rehabilitation apparatus according to the embodiment of the present invention when viewed from the front.

FIG. 1 is a perspective view showing a respiratory rehabilitation apparatus according to an embodiment of the present invention, and FIG. 2 is a cross-sectional view taken along line A-B in FIG. 1. FIG. 3 is an exploded perspective view showing the respiratory rehabilitation apparatus according to the embodiment of the present invention, and FIG. 4 is a cross-sectional view of the respiratory rehabilitation apparatus according to the embodiment of the present invention when viewed from the front.

As shown in FIGS. 1 to 4, a respiratory rehabilitation apparatus 500 according to an embodiment of the present invention includes a housing 510, an adjustment rod 570, stoppers 543 and 553, pressurization-movement parts 530 and 560, elastic members 544 and 554, and diaphragms 533 and 563.

First, it is preferable for the housing 510, which forms the external appearance of the apparatus, to be formed to have a hollow shape. Here, the housing 510 may have a hollow portion formed therein so as to have open opposite end portions, and air generated by user's respiration flows therethrough.

In addition, it is preferable that the housing 510 be provided on the inner circumference thereof with a plurality of guide protrusions 511, which are arranged at predetermined intervals in a circumferential direction, protrude in a radially inward direction, and extend in a longitudinal direction.

In detail, it is preferable for the guide protrusions 511 to be arranged in the circumferential direction, to protrude in the radially inward direction, and to extend in the longitudinal direction in accordance with the arrangement interval of a plurality of recesses 543*a* and 553*a*, which are formed in each of a pair of stoppers 543 and 553, which will be described later.

Accordingly, the guide protrusions 511 formed on the inner circumference of the housing 510 may be inserted into the recesses 543*a* and 553*a*, which are formed in the outer circumference of each of the stoppers 543 and 553. As a result, when the stoppers 543 and 553 move in the housing 510 in the longitudinal direction, the stoppers 543 and 553 may be supported by the guide protrusions 511, and thus may be prevented from rotating in the circumferential direction while moving in the longitudinal direction.

Of course, in some cases, the housing 510 may be provided on the inner circumference thereof with grooves, which are arranged at predetermined intervals in the circumferential direction, are recessed in the radially outward direction, and extend in the longitudinal direction. In this case, each of the pair of stoppers 543 and 553 may include protrusions, which are arranged in the circumferential direction and protrude in the radially outward direction in accordance with the arrangement interval and shape of the grooves.

In addition, it is preferable that the housing 510 be provided at opposite end portions thereof with stepped portions 513*a* and 513*b*, which gradually decrease in radius toward the end portions so as to be stepped in order to prevent separation of the pressurization-movement parts 530 and 560. In this case, it is preferable that the outer diameter of the end portions of the housing 510 be formed to be smaller than the outer diameter of the center portion of the housing 510.

As such, since the stepped portions 513*a* and 513*b* are formed inside opposite end portions of the housing 510, the pressurization-movement parts 530 and 560 inserted into the housing 510 may be prevented from escaping outwards in the longitudinal direction of the housing 510.

In addition, it is preferable that the housing 510 be formed so as to be divided into a first housing 510*a* and a second housing 510*b*. In some cases, the first housing 510*a* and the second housing 510*b* may be integrally formed with each other.

Here, it is preferable that the first housing 510*a* and the second housing 510*b* be coupled to a housing-coupling part 571 so as to be selectively and individually rotated in the circumferential direction in order to variably adjust a pressure load through the stoppers 543 and 553. A detailed description thereof will be made later.

Accordingly, when one of the first housing 510*a* and the second housing 510*b* is individually rotated in the circumferential direction, a corresponding one of the stoppers 543 and 553 disposed on the inner circumferences of the first and second housings may be moved in the longitudinal direction.

Meanwhile, it is preferable for the respiratory rehabilitation apparatus 500 to further include a mouthpiece 520, which is coupled to any one of opposite end portions of the housing 510. Here, the mouthpiece 520 may be coupled to the outer side in the longitudinal direction of any one of the first housing 510*a* and the second housing 510*b*. In this case, a silicon member or the like may be disposed between the housing 510 and the mouthpiece 520 in order to secure the coupling therebetween.

As such, since the mouthpiece 520 is provided separately from the housing 510 so as to be assembled with and disassembled from the housing 510, the mouthpiece 520 may be easily cleaned, and the convenience of use thereof may be increased. Of course, in some cases, the mouthpiece 520 may be integrally formed with the housing 510.

In addition, it is preferable for the mouthpiece 520 to be formed to have a hollow shape in order to guide the flow of air created by respiration. Here, one end portion of the mouthpiece 520 may be formed corresponding to the size of the mouth, which is standardized, so that a user may easily put the same into the mouth. In this case, the mouthpiece 520 may be designed and formed such that the outer diameter thereof gradually decreases toward one end thereof so that a user is capable of putting the mouthpiece 520 into the mouth even if the user does not open the mouth wide.

Meanwhile, it is preferable that the adjustment rod 570 include the housing-coupling part 571 and a pair of rod body parts 540 and 550. In this case, in the embodiment of the present invention, it is preferable that the adjustment rod 570 be understood to conceptually encompass the housing-coupling part 571 and the respective rod body parts 540 and 550.

In addition, the outer diameter of the housing-coupling part 571 may be formed so as to substantially match the outer diameter of the housing 510 so that the first housing 510*a* and the second housing 510*b* are coupled to opposite end portions of the housing-coupling part 571. In addition, the housing-coupling part 571 may be provided on the outer circumference thereof with a grip portion, which protrudes in the radially outward direction. Accordingly, a user may grasp the grip portion and may individually rotate any one of the first housing 510*a* and the second housing 510*b*.

Here, the housing-coupling part 571 may be disposed between the first housing 510*a* and the second housing 510*b* so that the first housing 510*a* and the second housing 510*b* are fitted into the housing-coupling part 571. In this case, the housing-coupling part 571 may be disposed such that the first housing 510*a* and the second housing 510*b* are partitioned from each other by the housing-coupling part 571 and such that the rim of the housing-coupling part 571 is exposed in the circumferentially outward direction.

In addition, the housing-coupling part 571 may be provided at the outer peripheral portion in the radial direction thereof with coupling portions 574*a* and 574*b*, which protrude and extend in longitudinally opposite depositions. In this case, the first housing 510*a* and the second housing 510*b* may be provided at the inner sides in the longitudinal direction thereof with fitting portions 512*a* and 512*b*, which are formed at the outer peripheral portions in the radial direction of the first housing 510*a* and the second housing 510*b* so as to match the coupling portions 574*a* and 574*b*.

Here, the fitting portions 512*a* and 512*b*, which are formed at the outer peripheral portions in the radial direction of the first housing 510*a* and the second housing 510*b*, may be formed at positions that are shifted in the radially inward direction or in the radially outward direction so as to be stepped as large as the width in the radial direction of the coupling portions 574*a* and 574*b*.

Accordingly, the housing-coupling part 571 and the housing 510 may be coupled to each other in a manner such that the fitting portions 512*a* and 512*b* are fitted to the inner circumferences or the outer circumferences of the coupling portions 574*a* and 574*b*.

In addition, the coupling portions 574*a* and 574*b* may be provided with a plurality of locking protrusions, which protrude in the radially inward direction or in the radially outward direction toward the fitting portions 512*a* and 512*b*, and the fitting portions 512*a* and 512*b* may be provided with a plurality of locking protrusions, which protrude in the radially inward direction or in the radially outward direction toward the coupling portions 574*a* and 574*b*. Accordingly, when the first housing 510*a* and the second housing 510*b* are coupled to the housing-coupling part 571, separation of these components may be prevented by the locking action of the locking protrusions.

Of course, in some cases, silicon members may be disposed between the housing-coupling part 571 and the first housing 510*a* and between the housing-coupling part 571 and the second housing 510*b*. In this case, since the silicon members are disposed between the coupling portions 574*a* and 574*b* and the fitting portions 512*a* and 512*b*, the first housing 510*a* and the second housing 510*b* may be coupled to the housing-coupling part 571 so as to be rotatable relative to each other. As such, since the silicon members are disposed at the contact region between the housing-coupling part 571 and the first housing 510*a* and at the contact region between the housing-coupling part 571 and the second housing 510*b*, it is possible to prevent the air flowing inside the housing 510 from leaking outside. Meanwhile, it is to be understood that the construction in which the first housing 510*a* and the second housing 510*b* are coupled to the housing-coupling part 571 using silicon members without forming the coupling portions 574*a* and 574*b* or the fitting portions 512*a* and 512*b* is also included in the scope of the invention.

Alternatively, in some cases, the first housing 510*a* and the second housing 510*b* may be formed so as to be in contact with each other and such that the housing-coupling part 571 may be fitted to the inner circumference of the housing 510. In this case, the outer diameter of the housing-coupling part 571 may be formed so as to substantially match the inner diameter of the housing 510. Accordingly, the housing-coupling part 571 may be inserted into the inner circumference of the housing 510 in the manner of being fitted to the inner circumference of the center portion in the longitudinal direction of the housing 510.

In addition, the housing-coupling part 571 may be disposed at the center portion in the longitudinal direction of the housing 510, and may be provided with a plurality of through-passages 572, which penetrate the housing-coupling part 571 in the longitudinal direction. Accordingly, the air introduced into the housing 510 may flow through the through-passages 572.

In addition, the housing-coupling part 571 may be provided at the center portion in the radial direction thereof with a rod-fixing portion 573, which is formed so as to have a bent cross-section and to have a hollow portion oriented in the longitudinal direction in order to maintain the fixed state when the first housing 510*a* and the second housing 510*b* individually rotate.

In detail, the rod-fixing portion 573 may be formed at the center portion in the radial direction of the housing-coupling part 571. The rod-fixing portion 573 may have fixing recesses 573*a* and 573*b* recessed therein in the longitudinal direction or may have a fixing hole (not shown) formed therethrough in the longitudinal direction.

The through-passages 572 may be formed in a plural number between the rod-fixing portion 573 and the inner circumference of the housing-coupling part 571 so as to surround the rod-fixing portion 573. In this case, the rod-fixing portion 573 may be provided on the outer periphery thereof with connection ribs, which are radially arranged in order to connect the rod-fixing portion 573 and the inner circumference of the housing-coupling part 571. In addition, a plurality of outer passages 572*a* may be formed at the inner side in the radial direction of the housing-coupling part 571, which is adjacent to the edge of the housing-coupling part 571. The outer passages 572*a* may be arranged in the circumferential direction and may extend in the longitudinal direction.

Meanwhile, it is preferable for the adjustment rod 570 to include the pair of rod body parts 540 and 550, which are provided on opposite sides in the longitudinal direction of the housing-coupling part 571 and have screw threads formed in the outer circumferences thereof.

In addition, the rod body parts 540 and 550 may be provided at the inner sides in the longitudinal direction thereof with insertion protrusions 541*a* and 551*a*, which are selectively inserted into or removed from the fixing recesses 573*a* and 573*b* or the fixing hole (not shown) in the longitudinal direction.

Here, the insertion protrusions 541*a* and 551*a* may be formed so as to have a bent cross-section and to correspond the shape of the fixing recesses 573*a* and 573*b* in order to maintain the fixed state when the first housing 510*a* and the second housing 510*b* individually rotate.

Accordingly, as the insertion protrusions 541*a* and 551*a* are inserted into the fixing recesses 573*a* and 573*b*, the rod body parts 540 and 550 may be fitted into the housing-coupling part 571. As such, since the rod body parts 540 and 550 are coupled to the housing-coupling part 571, the rod body parts 540 and 550 may be maintained in a fixed state when the first housing 510*a* and the second housing 510*b* individually rotate.

In addition, it is preferable that the rod body parts 540 and 550 be provided at the inner sides in the longitudinal direction thereof with a plurality of extending latching portions 542 and 552, which are radially arranged at predetermined intervals in the circumferential direction and protrude and extend in the radially outward direction so that the elastic members 544 and 554 are latched thereby. Here, the radial length of each of the extending latching portions 542 and 552 may be formed to be equal to or less than the radial length of the housing-coupling part 571.

Accordingly, the elastic members 544 and 554, which are disposed so as to surround the outer circumferences of the rod body parts 540 and 550, may be latched by the extending latching portions 542 and 552, and thus may be prevented from being separated in the longitudinally inward direction.

In some cases, the extending latching portions 542 and 552 are formed so as to have a radius that substantially matches the inner radius of the housing-coupling part 571, so that the end portions of the extending latching portions 542 and 552 may be fitted to the inner circumferences of the coupling portions 574*a* and 574*b*.

In addition, it is preferable that the rod body parts 540 and 550 be provided at the center portion in the longitudinal direction thereof with a plurality of rod bodies 541 and 551, which are radially arranged on cylindrical bars, which are disposed in the longitudinal direction, in the circumferential direction and protrude and extend in the radially outward direction. Here, the rod bodies 541 and 551 have screw threads formed in the outer circumferences thereof.

In detail, the rod bodies 541 and 551 preferably include a first rod body 541, which has a screw thread formed in the outer circumference thereof in one direction in order to change the pressure load that is generated during exhalation. In addition, the rod bodies 541 and 551 preferably include a second rod body 551, which has a screw thread formed in the outer circumference thereof in a direction opposite the direction in which the screw thread of the first rod body 541 is formed in order to change the pressure load that is generated during inhalation.

Accordingly, when the first housing 510*a* and the second housing 510*b* individually rotate, the stoppers 543 and 553, which are disposed between the outer circumferences of the rod bodies 541 and 551 and the inner circumference of the housing 510, may be moved in the longitudinal direction.

In addition, the rod bodies 541 and 551 and the extending latching portions 542 and 552 may be radially arranged in the circumferential direction and may protrude and extend in the radially outward direction. As a result, air introduced into the housing 510 may flow along the space between the rod bodies 541 and 551 and between the extending latching portions 542 and 552.

Meanwhile, the stoppers 543 and 553 may be formed to have a hollow shape so as to be coupled to the outer circumferences of rod body parts 540 and 550, and may have screw threads formed in the inner circumferences thereof. It is preferable that the stoppers 543 and 553 be provided in a pair in order to selectively and individually adjust respiration pressures.

Here, the stoppers 543 and 553 may be formed in a ring shape, and the edges of the hollow portions thereof may extend outwards in the longitudinal direction so as to be latched by the inner spiral circumferences of the elastic members 544 and 554. Further, it is preferable that the stoppers 543 and 553 have screw threads formed in the inner circumferences thereof so as to match the outer circumferences of the rod bodies 541 and 551.

Each of the stoppers 543 and 553 may be disposed on the outer circumference of a corresponding one of the first rod body 541 and the second rod body 551, in which the screw thread is formed. In this case, the first stopper 543 may be disposed on the outer circumference of the first rod body 541, and the second stopper 553 may be disposed on the outer circumference of the second rod body 551.

In addition, it is preferable that the stoppers 543 and 553 be provided in the outer circumferences thereof with recesses 543*a* and 553*a*, which are arranged in the circumferential direction so as to match the arrangement intervals of the guide protrusions 551 and are recessed in the radially inward direction so that the guide protrusions 511 are inserted thereinto.

Accordingly, the guide protrusions 511 are inserted into and caught in the recesses 543*a* and 553*a* in the stoppers 543 and 553, thereby preventing rotation in the circumferential direction. As a result, when a user individually rotates the first housing 510*a* and the second housing 510*b*, the first stopper 543 and the second stopper 553 may be individually moved.

Thus, when the first housing 510*a* and the second housing 510*b* are individually rotated, the stoppers 543 and 553 may be moved in the longitudinal direction, and thus the intensity of the elastic restoring force of each of the elastic members 544 and 554 may be adjusted. As a result, the respiratory rehabilitation apparatus 500 may individually adjust the exhalation pressure strength and the inhalation pressure strength, thereby greatly improving convenience of use.

Further, the stoppers 543 and 553 may be selectively and individually moved in the longitudinal direction by the rod bodies 541 and 551, which have the screw threads formed in outer circumferences thereof. Accordingly, the respiratory rehabilitation apparatus 500 may individually adjust the exhalation pressure and the inhalation pressure in consideration of the user's lung capacity or the like, thereby improving convenience of use.

In some cases, the stoppers 543 and 553 may be provided at the outer periphery in the radial direction thereof with a plurality of communication passages (not shown), which are arranged in the circumferential direction. Further, in some cases, the stoppers 543 and 553 may be formed in a ring shape. However, the stoppers 543 and 553 may be formed in a semicircular 'C' shape in which an inner side in the radial direction thereof is recessed in a circular cross-sectional shape. Here, the stoppers 543 and 553 may be disposed at the end portions of the elastic members 544 and 554. In some cases, the stoppers 543 and 553 may be disposed at a portion of the outer circumferences of the elastic members 544 and 554 so as to be inserted into a portion of the springs of the elastic members 544 and 554. Accordingly, the areas in the radial direction of the stoppers 543 and 553 may be minimized, with the result that the flow rate per unit time of the air, which flows inside the housing 510 in the longitudinal direction, may increase.

Meanwhile, the pressurization-movement parts 530 and 560 may be provided in a pair, and may be provided at the center portions thereof with protrusions 531 and 561, which extend outwards in the longitudinal direction. It is preferable that the pressurization-movement parts 530 and 560 have a plurality of respiration passages 532 and 562 formed therethrough in the longitudinal direction while surrounding the protrusions 531 and 561.

Here, the pressurization-movement parts 530 and 560 may be formed in a ring shape, and the pressurization-movement parts 530 and 560 may be provided with connection ribs, which are radially arranged in order to connect pressurization-movement parts 530 and 560 and the protrusions 531 and 561.

In addition, it is preferable that the protrusions 531 and 561 extend from the center portions in the radial direction of the pressurization-movement parts 530 and 560 in the longitudinally outward direction so as to be inserted into the diaphragms 533 and 563 having through-holes 533*a* and 563*a* formed in the center portion thereof. In this case, the protrusions 531 and 561 may be integrally formed with the pressurization-movement parts 530 and 560. However, in some cases, the protrusions 531 and 561 and the pressurization-movement parts 530 and 560 may be provided separately from each other and may be coupled to each other.

In addition, it is preferable that the respiration passages 532 and 562 may extend between the pressurization-movement parts 530 and 560 and the protrusions 531 and 561 in the longitudinal direction while surrounding the protrusions 531 and 561. In this case, it is preferable that the diaphragms 533 and 563 be disposed so as to be in close contact with the outer sides in the longitudinal direction of the pressurization-movement parts 530 and 560. Accordingly, when a user respires, air may selectively flows through the respiration passages 532 and 562.

In addition, when a user respires, the pressurization-movement parts 530 and 560 may be individually pressurized and moved to the inner side in the longitudinal direction of the housing by the respiration pressure. Here, the outer diameter of rims 534*a* and 564*a* of the pressurization-movement parts 530 and 560 may be formed so as to substantially match the inner diameter of the end portion of the housing 510.

In addition, it is preferable that the pressurization-movement parts 530 and 560 be provided at the rims 534*a* and 564*a* thereof with latching-fixing portions 534 and 564, which are arranged at predetermined intervals in the circumferential direction and extend in the radially outward direction so as to be latched by the stepped portions 513*a* and 513*b*.

Accordingly, when the pressurization-movement parts 530 and 560 are pressurized inwards in the longitudinal direction by user's respiration, air may flow between the inner circumference of the housing 510 and the rims 534*a* and 564*a* of the pressurization-movement parts 530 and 560.

In detail, during the exhalation, the first pressurization-movement part 530, the inhalation passage 532 of which is closed by the first diaphragm 533, is pressurized inwards in the longitudinal direction by the elastic restoring force of the first elastic member 544, and air flows to the outer periphery of the first rim 534*a* of the first pressurization-movement part 530. Subsequently, the air moved to the outer periphery of the first rim 534*a* passes through the exhalation passage 562, pushes the second diaphragm 563 outwards in the longitudinal direction, and is discharged outside.

On the other hand, during the inhalation, the second pressurization-movement part 560, the exhalation passage 562 of which is closed by the second diaphragm 563, is pressurized inwards in the longitudinal direction by the elastic restoring force of the second elastic member 554, and air flows to the outer periphery of the second rim 564. Subsequently, the air moved to the outer periphery of the second rim 564 passes through the inhalation passage 532, pushes the first diaphragm 533 outwards in the longitudinal direction, and is suctioned into the user's mouth.

As such, since the respiratory rehabilitation apparatus having two functions, i.e. exhalation and inhalation, is formed in a unitary body, expiratory muscle training and inspiratory muscle training may be successively and naturally realized, the apparatus may be reduced in size and may be easy to carry, the manufacturing costs thereof may be reduced, and consequently the productivity thereof may be improved. Further, since a user is capable of successively performing expiratory muscle training and inspiratory muscle training without changing the mounting position of the mouthpiece 520 during the respiratory muscle strengthening exercises, thereby greatly improving convenience of use.

Meanwhile, the elastic members 544 and 554 may be implemented as a pair of springs, may be provided between the pressurization-movement parts 530 and 560 and the stoppers 543 and 553 so as to be selectively pressed, and may be disposed so as to surround the outer circumferences of the rod body parts 540 and 550.

Here, when the stoppers 543 and 553 are moved in the longitudinal direction due to the rotation of the housing 510, the intensities of the elastic restoring force of the elastic members 544 and 554 may be selectively adjusted.

Accordingly, when a user respires, since the elastic restoring force of the elastic members 544 and 554 is adjusted by the stoppers 543 and 553, it is possible to selectively adjust the respiratory strength required to push the pressurization-movement parts 530 and 560 inwards in the longitudinal direction.

Of course, in some cases, the elastic members may be implemented as magnets. In detail, a first magnet (not shown) may be disposed at the outer side in the longitudinal direction of the stopper. In addition, a second magnet (not shown), which pushes the first magnet (not shown) due to repulsive force, may be disposed at the inner side in the longitudinal direction of the pressurization-movement part. Accordingly, when the pressurization-movement part is pressurized by the repulsive force between the first magnet (not shown) and the second magnet (not shown), repulsive restoring force may be provided. In this case, the magnitude of the repulsive restoring force may be adjusted by adjusting the position in the longitudinal direction of the stopper.

Meanwhile, the diaphragms 533 and 563 may have through-holes 533*a* and 563*a* formed in the center portion thereof so that the protrusions 531 and 561 are inserted, and may be provided in a pair so as to be in close contact with the outer sides in the longitudinal direction of the pressurization-movement parts. In this case, the diaphragms 533 and 563 may be made of a material having excellent adhesion, such as silicon, rubber, synthetic resin, or the like.

Here, it is preferable that the outer diameter of the diaphragms 533 and 563 be formed so as to substantially match the outer diameter of the rims 534*a* and 564*a* of the pressurization-movement parts 530 and 560 so as to cover the outer sides in the longitudinal direction of the respiration passages 532 and 562.

In this case, if the outer diameter of the diaphragms 533 and 563 exceeds the outer diameter of the rims 534*a* and 564*a*, the flow of air generated by the diaphragms 533 and 563 during respiration may be interrupted. On the other hand, if the outer diameter of the diaphragm 533 and 563 is formed to be less than the outer diameter of the rims 534*a* and 564*a*, the air generated during respiration may be discharged through the respiration passages 532 and 562, and thus the pressurization-movement parts 530 and 560 may not be pressurized.

Therefore, the outer diameter of the diaphragms 533 and 563 is formed so as to substantially match the outer diameter of the rims 534*a* and 564*a*, whereby the flow path of air generated during respiration may be optimized. Here, "optimization" means that, during exhalation, air flows to the outer periphery of the first rim 534*a* and then passes through the exhalation passage 562 and that, during inhalation, air flows to the outer periphery of the second rim 564 and then passes through the inhalation passage 532.

In addition, separation-preventing portions 514*a* and 514*b* may be provided inside opposite end portions of the housing 510 in order to prevent the diaphragms 533 and 563 from being separated outwards in the longitudinal direction. In this case, the separation-preventing portions 514*a* and 514*b* may be formed in a ring shape so that the protrusions 531 and 561 are inserted into the inner circumferences thereof. In addition, it is preferable for the separation-preventing portions 514*a* and 514*b* to be spaced a predetermined interval apart from the diaphragms 533 and 563.

Accordingly, during exhalation, air passes through the exhalation passage 562 and is discharged outside while pushing the second diaphragm 563 outwards in the longitudinal direction, but the second diaphragm 563 is caught by the second separation-preventing portion 514*b* and thus is prevented from being separated. Further, during inhalation, air passes through the inhalation passage 532 and is introduced into the mouth while pushing the first diaphragm 533 outwards in the longitudinal direction, but the first diaphragm 563 is caught by the first separation-preventing portion 514*a* and thus is prevented from being separated. As such, during respiration, the diaphragms 533 and 563, which are moved outwards in the longitudinal direction by the air pressure, are caught by the separation-preventing portions 514*a* and 514*b* and thus are prevented from being separated, thereby improving convenience of use.

Of course, in some cases, in order to cause the diaphragms 533 and 563 to be caught by the stepped portions 513*a* and 513*b* and thus to be prevented from being separated, the outer diameter of the diaphragms 533 and 563 may be formed so as to slightly exceed the inner diameter of the end portions of the housing 510.

Meanwhile, in some cases, the respiratory rehabilitation apparatus 500 may further include an inhalation inlet (not shown) and a vibration ball part (not shown). In this case, the inhalation inlet (not shown) and the vibration ball part (not shown) may be provided so as to replace at least one of the pressurization-movement parts 530 and 560. For example, the first pressurization-movement part 530 may be removed from the respiratory rehabilitation apparatus 500, and the inhalation inlet (not shown) and the vibration ball part (not shown) may be disposed at the position of the first pressurization-movement part 530.

In detail, the inhalation inlet (not shown) may be disposed so as to be in close contact with the inner circumference of the housing 510. In addition, the inhalation inlet (not shown) may be formed in a ring shape, and a through-hole (not shown) may be formed through the center portion in the radial direction thereof. In addition, an opening/closing passage (not shown) may be formed through one side of the inhalation inlet (not shown). The opening/closing passage (not shown) may extend in the longitudinal direction, and may be selectively closed and opened by a third diaphragm (not shown) so that air generated by inhalation may flow therethrough. In addition, there may be provided a vibration ball part (not shown), which includes a seat rim portion (not shown), one side of which is inserted into the through-hole (not shown) so as to extend in the longitudinal direction. A ball (not shown), which generates repulsive load with respect to the inhalation pressure during inhalation, is seated in the seat rim portion (not shown), and selectively opens and closes the seat rim portion (not shown). Here, the seat rim portion (not shown) may be formed such that the radius thereof gradually increases from the through-hole (not shown) to the inner side in the longitudinal direction. In addition, when the ball (not shown) is seated in the inner circumference of the inclined surface of the seat rim portion (not shown), the through-hole (not shown) may be closed. In addition, the ball (not shown) may perform reciprocating movement in the longitudinal direction between the first elastic member 544 and the inclined surface of the seat rim portion (not shown) due to the air generated by exhalation.

Accordingly, during exhalation, air may flow from the mouthpiece 520 to the through-hole (not shown) through the vibration of the ball (not shown), and the opening/closing passage (not shown) may be closed by the third diaphragm (not shown). In addition, during inhalation, the through-hole (not shown) may be closed by the ball (not shown), the third diaphragm (not shown) may be opened by the air pressure, and air may flow to the opening/closing passage.

Figure 5:
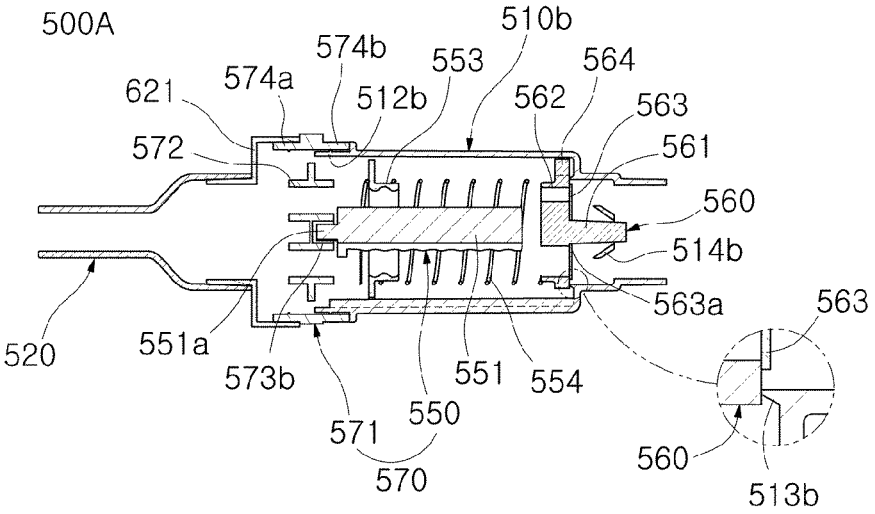
FIG. 5 is a cross-sectional view showing a first modified example of the respiratory rehabilitation apparatus according to the embodiment of the present invention when viewed from the side.
Figure 6:
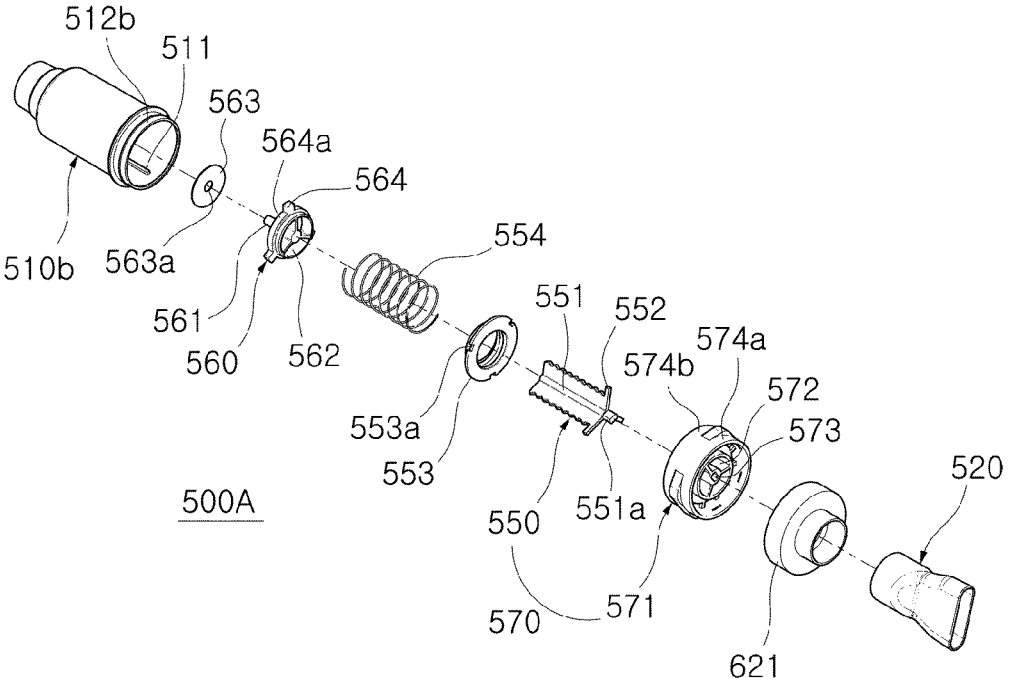
FIG. 6 is an exploded perspective view showing the first modified example of the respiratory rehabilitation apparatus according to the embodiment of the present invention.

FIG. 5 is a cross-sectional view showing a first modified example of the respiratory rehabilitation apparatus according to the embodiment of the present invention when viewed from the side, and FIG. 6 is an exploded perspective view showing the first modified example of the respiratory rehabilitation apparatus according to the embodiment of the present invention. A respiratory rehabilitation apparatus 500A according to the first modified example of the embodiment of the present invention has the same basic configuration as the embodiment described above, except for a piece-coupling part 621, and thus a detailed description of the same configuration will be omitted.

Here, it is to be understood that the respiratory rehabilitation apparatus 500A according to the first modified example of the embodiment of the present invention has a configuration in which the respective components providing inspiratory muscle training (IMT) are separated from the embodiment described above.

In detail, it is preferable for the respiratory rehabilitation apparatus 500A according to the first modified example of the embodiment of the present invention to further include a piece-coupling part 621, an inner end portion in the longitudinal direction of which is coupled to a first coupling portion 574*a* formed at the edge of one end portion of the housing-coupling part 571. In addition, it is preferable for the respiratory rehabilitation apparatus 500A to further include a mouthpiece 520, which is coupled to the outer end portion in the longitudinal direction of the piece-coupling part 621.

Preferably, the center portion in the radial direction of the piece-coupling part 621 is formed to be hollow, and the piece-coupling part 621 extends in the longitudinal direction. Preferably, one side of the piece-coupling part 621 is fitted to the inner end portion in the longitudinal direction of the mouthpiece 520, and the opposite side thereof is fitted to the housing-coupling part 571.

To this end, the outer diameter of one side of the piece-coupling part 621 is formed so as to substantially match the outer diameter of the inner end in the longitudinal direction of the mouthpiece 520. In addition, the outer diameter of the opposite side of the piece-coupling part 621 is formed so as to substantially match the outer diameter of the housing-coupling part 571. In this case, one side of the piece-coupling part 621 may be fitted to the inner circumference or the outer circumference of the inner end in the longitudinal direction of the mouthpiece 520, and the opposite side of the piece-coupling part 621 may be fitted to the inner circumference or the outer circumference of the housing-coupling part 520. Here, when the outer diameter of the mouthpiece 520 and the outer diameter of the housing-coupling part 571 are different, a stepped portion may be formed so as to extend from the center portion in the longitudinal direction of the piece-coupling part 621 in the radially outward direction.

Accordingly, one side of the piece-coupling part 621 may be fitted to the inner end in the longitudinal direction of the mouthpiece 520, and the opposite side thereof may be fitted to the first coupling portion 574*a* of the housing-coupling part 571.

Thus, a user may separate the first housing 510*a* (refer to FIG. 1) of the above embodiment and the housing-coupling part 571 from each other, and may couple the mouthpiece 520 and the piece-coupling part 621 to the housing-coupling part 571.

Accordingly, during exhalation, air flows into the second housing 510*b* via the mouthpiece 520 and the piece-coupling part 621, passes through the exhalation passage 562, and thereafter is discharged outside while pushing the second diaphragm 563 outwards in the longitudinal direction.

On the other hand, during inhalation, the second pressurization-movement part 560, in which the exhalation passage 562 is closed by the second diaphragm 563, is pressurized inwards in the longitudinal direction by the elastic restoring force of the second elastic member 554, and air flows to the outer periphery of the second rim 564. Subsequently, the air that has moved to the outer periphery of the second rim 564 passes through the inhalation passage 532 and is suctioned into the user's mouth while pushing the first diaphragm 533 outwards in the longitudinal direction.

Accordingly, it is possible to provide inspiratory muscle training merely by coupling the mouthpiece 520 and the piece-coupling part 621 to the housing-coupling part 571 and to easily separate these components, thereby enabling the independent use thereof and consequently greatly improving convenience of use.

Figure 7:
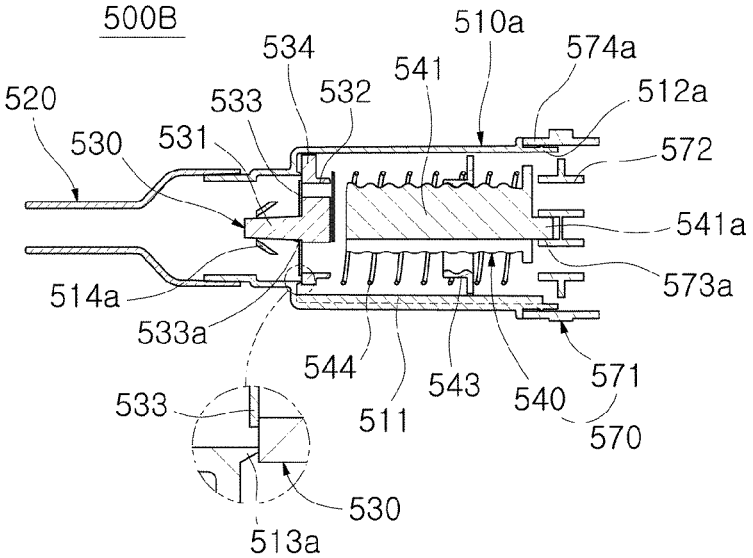
FIG. 7 is a cross-sectional view showing a second modified example of the respiratory rehabilitation apparatus according to the embodiment of the present invention when viewed from the side.
Figure 8:
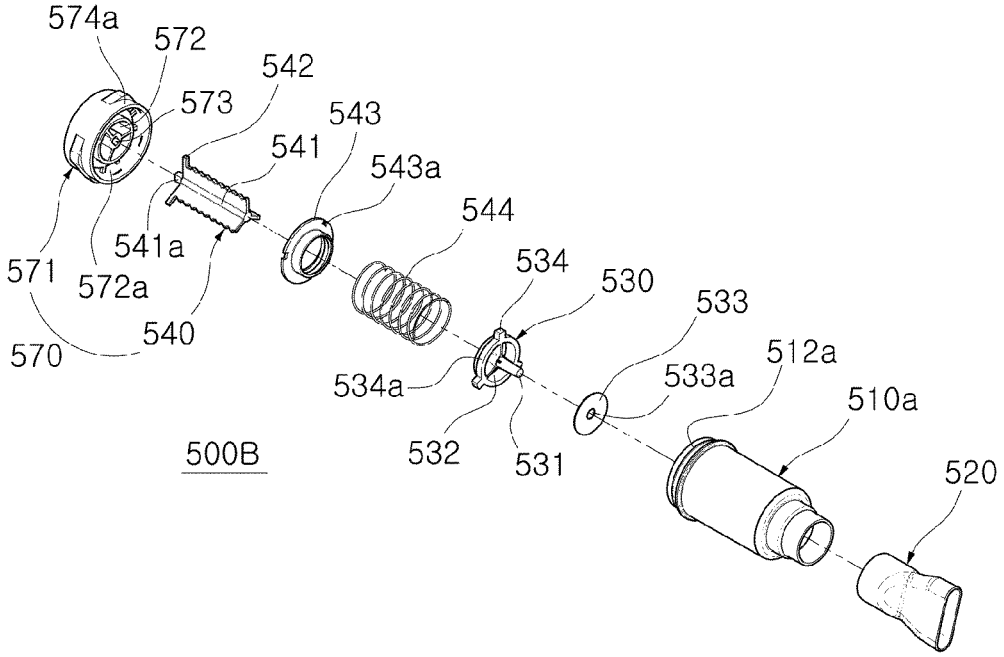
FIG. 8 is an exploded perspective view showing the second modified example of the respiratory rehabilitation apparatus according to the embodiment of the present invention.

FIG. 7 is a cross-sectional view showing a second modified example of the respiratory rehabilitation apparatus according to an embodiment of the present invention when viewed from the side, and FIG. 8 is an exploded perspective view showing the second modified example of the respiratory rehabilitation apparatus according to the embodiment of the present invention. A respiratory rehabilitation apparatus 500B according to the second modified example of the embodiment of the present invention has the same basic configuration as the embodiment described above, and thus a detailed description of the same configuration will be omitted.

Here, it is to be understood that the respiratory rehabilitation apparatus 500B according to the second modified example of the embodiment of the present invention has a configuration in which the respective components providing positive expiratory pressure (PEP) are separated from the embodiment described above.

Therefore, a user may use the apparatus by separating the second housing 510*b* (refer to FIG. 1) of the above embodiment and the housing-coupling part 571 from each other.

Accordingly, during exhalation, the first pressurization-movement part 530, in which the inhalation passage 532 is closed by the first diaphragm 533, is pressurized inwards in the longitudinal direction by the elastic restoring force of the first elastic member 544, and air flows to the outer periphery of the first rim 534*a* of the first pressurization-movement part 530. Subsequently, the air that has moved to the outer periphery of the first rim 534*a* passes through the interior of the first housing 510*a* and is discharged outside via the through-passages 572 and the outer passage.

On the other hand, during inhalation, air flows into the first housing 510*a* via the through-passages 572 and the outer passage, passes through the inhalation passage 532, and thereafter is suctioned into the user's mouth while pushing the first diaphragm 533 outwards in the longitudinal direction.

Accordingly, the components providing positive expiratory pressure are easily separated and independently used, thereby greatly improving convenience of use.

Figure 9:
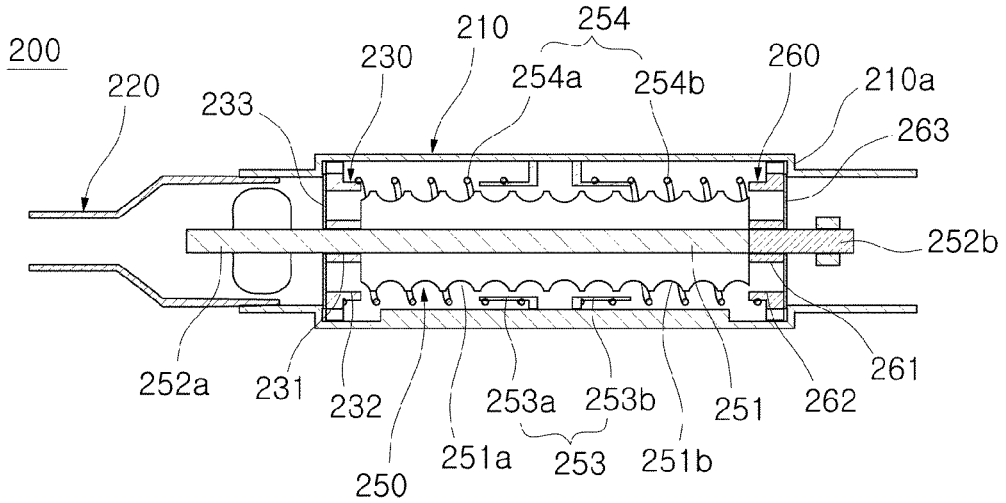
FIG. 9 is a cross-sectional view of a respiratory rehabilitation apparatus according to another embodiment of the present invention when viewed from the side.
Figure 10:
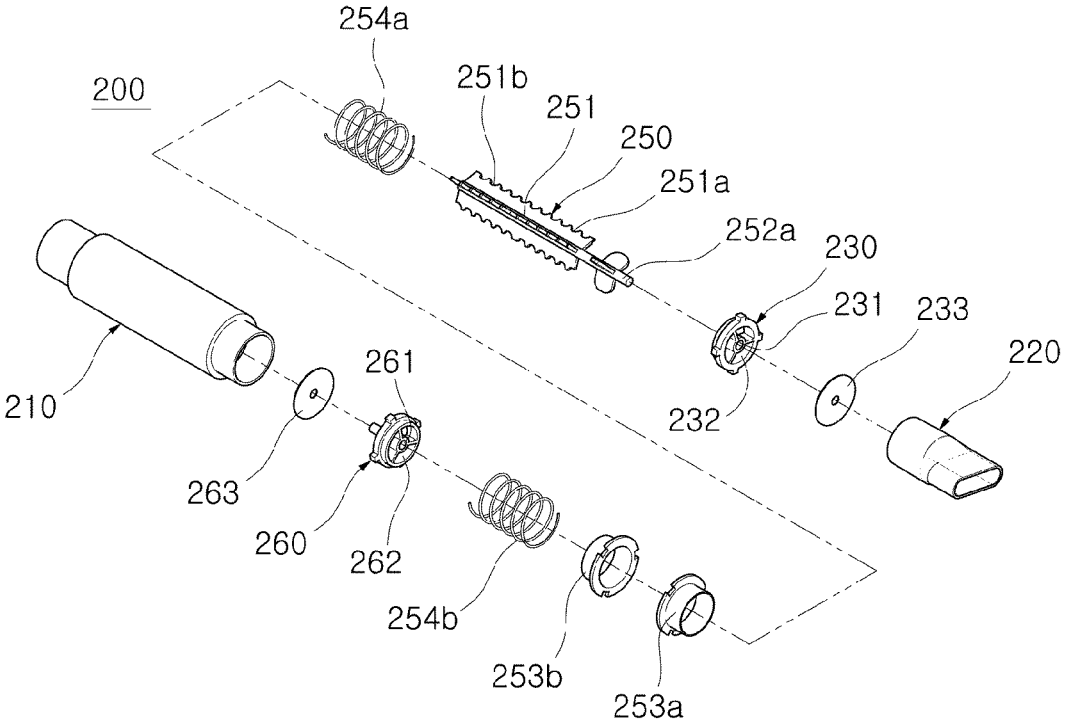
FIG. 10 is an exploded perspective view showing the respiratory rehabilitation apparatus according to another embodiment of the present invention.

FIG. 9 is a cross-sectional view of a respiratory rehabilitation apparatus according to another embodiment of the present invention when viewed from the side, and FIG. 10 is an exploded perspective view showing the respiratory rehabilitation apparatus according to another embodiment of the present invention. This embodiment of the present invention has the same basic configuration as the embodiment described above, except for pressurization-movement parts 230 and 260 and an adjustment rod 250, and thus a detailed description of the same configuration will be omitted.

As shown in FIGS. 9 and 10, a respiratory rehabilitation apparatus 200 according to an embodiment of the present invention includes a housing 210, a mouthpiece 220, pressurization-movement parts 230 and 260, and an adjustment rod 250. Here, the housing 210 is formed in a unitary body, unlike the configuration in which the housing is divided into the first housing 510*a* (refer to FIG. 1) and the second housing 510*b* (refer to FIG. 1).

Meanwhile, it is preferable for the pressurization-movement parts 230 and 260 to include a first pressurization-movement part 230 and a second pressurization-movement part 260. Preferably, the first pressurization-movement part 230 is disposed in the housing 210, and includes an inhalation body, which has a first through-hole 231 formed therein. Preferably, the first pressurization-movement part 230 includes an inhalation passage 232, which is formed in one side of the inhalation body so as to extend in the longitudinal direction and to be selectively closed and opened by the first diaphragm 233.

In addition, the first through-hole 231 is formed in the center portion of the first pressurization-movement part 230 so that a rod extension portion 252*a* of the adjustment rod 250 is inserted therethrough. In this case, the first through-hole 231, into which the rod extension portion 252*a* is inserted, may be formed to have an inner diameter that substantially matches the outer diameter of the rod extension portion 252*a*. In addition, in some cases, a bearing may be further provided in order to rotatably support the first through-hole 231 and the rod extension portion 252*a* while realizing a seal therebetween.

In addition, the inhalation passage 232 may be provided in a plural number so as to be radially disposed outside the periphery of the first through-hole 231. The plurality of inhalation passages 232 may be arranged in the circumferential direction so as to surround the periphery of the first through-hole 231 and may extend in the longitudinal direction. During inhalation, air located in the housing 210 may move to the mouthpiece 220 via the inhalation passages 232.

In addition, the first diaphragm 233 is preferably provided so as to open the inhalation passages 232 in one direction of the housing 210 due to the inhalation pressure during inhalation. In addition, the first diaphragm 233 may be formed in a ring shape that has a hollow center portion. In detail, the first diaphragm 233 is preferably disposed inside the housing 210 so as to be caught by a stepped portion formed in the housing 210. It is preferable that the outer diameter of the first diaphragm 233 be formed to be larger than the outer diameter of one end portion of the housing 210 in order to prevent the housing 210 from being separated outside. In this case, it is preferable that the outer diameter of the first diaphragm 233 be formed so as to substantially match the outer diameter of the rim of the first pressurization-movement part 230.

Preferably, the first diaphragm 233 is disposed at one end portion of the housing 210 and the first pressurization-movement part 230 is disposed so as to be in close contact with one surface of the first diaphragm 233, so that the inhalation passages 232 are closed by the first diaphragm 233. Here, it is preferable that the first diaphragm 233 be made of a material that is easily elastically deformed by external force or pressure applied thereto, such as silicon or rubber. Accordingly, during inhalation, the first diaphragm 233 may be expanded in one direction of the housing 210 by the inhalation pressure, and thus the inhalation passages 232 may be opened to allow air to flow therethrough. That is, when exhalation occurs, the first diaphragm 233 closes the inhalation passages 232, thereby preventing the flow of air. On the other hand, when inhalation occurs, the first diaphragm 233 is expanded in one direction of the housing 210 by the inhalation pressure, and thus the flow of air is allowed.

As such, the first diaphragm 233 closes the inhalation passages 232 and selectively allows the flow of air only during exhalation. That is, the flow of air may be easily adjusted with a simple configuration.

Meanwhile, the adjustment rod 250 preferably includes the rod extension portion 252*a* and a rotation adjustment portion 252*b*, which extend from the rod body 251 to opposite sides in the longitudinal direction. Preferably, the rod extension portion 252*a* may integrally extend from the first rod body 251*a* such that, when the mouthpiece 220 rotates in the circumferential direction, the first stopper 253*a* selectively moves in the longitudinal direction in order to change the pressure load of the first elastic member 254*a*. In this case, the rod extension portion 252*a* may be connected to one side of the mouthpiece 220.

In detail, the adjustment rod 250 is inserted into the housing 210 and is preferably provided in a pair in order to change the pressure load generated during respiration. In addition, the respiratory rehabilitation apparatus 200 preferably includes a stopper 253, which has a screw thread formed in the inner circumference thereof and into which at least one side of the rod body 251 is inserted. In addition, the respiratory rehabilitation apparatus 200 preferably includes a pair of elastic members 254, which are fitted to the stopper 253.

Here, the adjustment rod 250 preferably includes the rod body 251, in which screw threads are formed in directions opposite each other with respect to the center portion thereof. The rod body 251 preferably includes a first rod body 251*a* having a screw thread formed in one direction in order to change the pressure load generated during exhalation. In addition, the rod body 251 preferably includes a second rod body 251*b*, which is integrally formed with the first rod body 251*a* and has a screw thread formed in a direction opposite the direction in which the screw thread of the first rod body 251*a* is formed in order to change the pressure load generated during inhalation.

In addition, the adjustment rod 250 preferably includes the rotation adjustment portion 252*b*, which integrally extends from the rod body 251 toward the opposite side of the housing 210 and the distal end portion of which is exposed through the opposite side of the housing 210.

In addition, the rod extension portion 252*a* may integrally extend from the first rod body 251*a* and may be connected to one side of the mouthpiece 220. Accordingly, when the mouthpiece 220 rotates in the longitudinal direction, the first stopper 235*a* selectively moves in the longitudinal direction, thereby adjusting the pressure load of the first elastic member 254*a*.

In addition, the respiratory rehabilitation apparatus 200 preferably includes the pair of stoppers 253, which have screw threads formed in the inner circumferences thereof and into which the rod body 251 is inserted. Preferably, the stoppers 253 are disposed on the outer circumferences of the first rod body 251*a* and the second rod body 251*b*, in which the screw threads are formed. In this case, the first stopper 253*a* may be disposed on the outer circumference of the first rod body 251*a*, and the second stopper 253*b* may be disposed on the outer circumference of the second rod body 251*b*.

In addition, it is preferable that the stoppers 253 be provided in the outer circumferences thereof with recesses, which are arranged at predetermined intervals in the circumferential direction and are recessed in the radially inward direction. Here, it is preferable that the housing 210 be provided on the inner circumference thereof with a plurality of guide protrusions, which protrude in the radially inward direction and extend in the longitudinal direction in accordance with the arrangement intervals of the recesses. Accordingly, the guide protrusions are inserted into and caught in the recesses in the stoppers 253, thereby preventing rotation in the circumferential direction.

Accordingly, when a user rotates any one of the rod extension portion 252*a* and the rotation adjustment portion 252*b*, the entire adjustment rod 250 may be rotated. In this case, the stoppers 253 may be caught by the guide protrusions. Accordingly, the stoppers 253 may be moved in the longitudinal direction along the screw threads formed in the outer circumference of the adjustment rod 250. At this time, the stoppers 253 may be moved in different directions from each other.

For example, when any one of the rod extension portion 252*a* and the rotation adjustment portion 252*b* is rotated in one direction, the stoppers 253 may be simultaneously moved inwards in the longitudinal direction of the housing 210. In addition, when any one of the rod extension portion 252*a* and the rotation adjustment portion 252*b* is rotated in the opposite direction, the stoppers 253 may be simultaneously moved outwards in the longitudinal direction of the housing 210. Of course, the opposite configuration is also possible.

In addition, it is preferable for the respiratory rehabilitation apparatus 200 to include a pair of elastic members 254. In this case, the stoppers 253 may include extending protruding portions, which protrude and extend from the inner end portions thereof toward the elastic members 254 so that the elastic members 254 are inserted and fixed thereto. Accordingly, each of the elastic members 254 may be inserted and fixed to a respective one of the stoppers 253.

Here, the first elastic member 254*a* may be inserted and fixed to the first stopper 253*a* and may be disposed so as to surround the outer circumference of the first rod body 251*a*. In addition, the second elastic member 254*b* may be inserted and fixed to the second stopper 253*b* and may be disposed so as to surround the outer circumference of the second rod body 251*b*. Accordingly, the positions of the stoppers 253 may be adjusted by rotating any one of the rod extension portion 252*a* and the rotation adjustment portion 252*b*. As a result, the pressures of the elastic members 254 may be selectively adjusted, and accordingly the strength of the elastic restoring force thereof may be adjusted.

Therefore, air generated in the mouthpiece 220 by the user's exhalation may pressurize the first pressurization-movement part 230 inwards in the longitudinal direction, and thus the first pressurization-movement part 230 may be moved in the longitudinal direction. Accordingly, the positions of the stoppers 253 may be adjusted by rotating any one of the rod extension portion 252*a* and the rotation adjustment portion 252*b*, and thus the pressures of the elastic members 254 may be selectively adjusted. As a result, it is possible to easily adjust the strength of the exhalation pressure required to pressurize the first pressurization-movement part 230.

Meanwhile, it is preferable that the second pressurization-movement part 260 be provided in the center portion of an exhalation body thereof with a second through-hole 261 so that the adjustment rod 250 is inserted thereinto. In this case, the second through-hole 261, into which the adjustment rod 250 is inserted, may be formed to have an inner diameter that substantially matches the outer diameter of the insertion portion of the adjustment rod 250. In addition, in some cases, a bearing may be further provided in order to rotatably support the second through-hole 261 and the adjustment rod 250 while realizing a seal therebetween.

In addition, the exhalation passage 262 may be provided in a plural number so as to be radially disposed outside the periphery of the second through-hole 261. The plurality of exhalation passages 262 may be arranged in the circumferential direction so as to surround the periphery of the second through-hole 261 and may extend.

Here, during exhalation, air located in the housing 210 may move outside the housing 210 via the exhalation passages 262. In the case, the exhalation passages 262 may extend in the longitudinal direction and may be formed in an arc or circular shape so that air flows therethrough during exhalation.

In addition, the second diaphragm 263 is preferably provided so as to open the exhalation passages 262 in the opposite direction of the housing 210 due to the exhalation pressure during exhalation. In addition, the second diaphragm 263 may be formed in a ring shape that has a hollow center portion. In detail, the second diaphragm 263 is preferably disposed inside the housing 210 so as to be disposed between the second pressurization-movement part 260 and the stepped portion 210*a*.

It is preferable that the outer diameter of the second diaphragm 263 be formed to be larger than the outer diameter of the opposite end portion of the housing 210 in order to prevent the housing 210 from being separated outside. In this case, it is preferable that the outer diameter of the second diaphragm 263 be formed so as to substantially match the outer diameter of the rim.

Preferably, the second diaphragm 263 is disposed at the end portion of the housing 210 and the exhalation body is disposed so as to be in close contact with one surface of the second diaphragm 263, so that the exhalation passages 262 are closed by the second diaphragm 263.

In addition, it is preferable that the second diaphragm 263 be made of a material that is easily elastically deformed by external force or pressure applied thereto, such as silicon or rubber. Accordingly, during exhalation, the second diaphragm 263 may be expanded in the opposite direction of the housing 210 by the exhalation pressure, and thus the exhalation passages 262 may be opened to allow air to flow therethrough. That is, when inhalation occurs, the second diaphragm 263 closes the exhalation passages 262, thereby preventing the flow of air. On the other hand, when exhalation occurs, the second diaphragm 263 is expanded outwards in the longitudinal direction by the exhalation pressure, and thus the flow of air is allowed. Accordingly, the second diaphragm 263 closes the exhalation passages 262 so as to selectively allow air to flow only during exhalation, thereby easily realizing automatic adjustment of the flow of air.

As such, since the respiratory rehabilitation apparatus 200 is configured such that an expiratory muscle training device and an inspiratory muscle training device are integrated with each other, expiratory muscle training and inspiratory muscle training may be successively and naturally realized, the apparatus may be reduced in size and may be easy to carry, the manufacturing costs thereof may be reduced, and consequently the productivity thereof may be improved.

Figure 11:
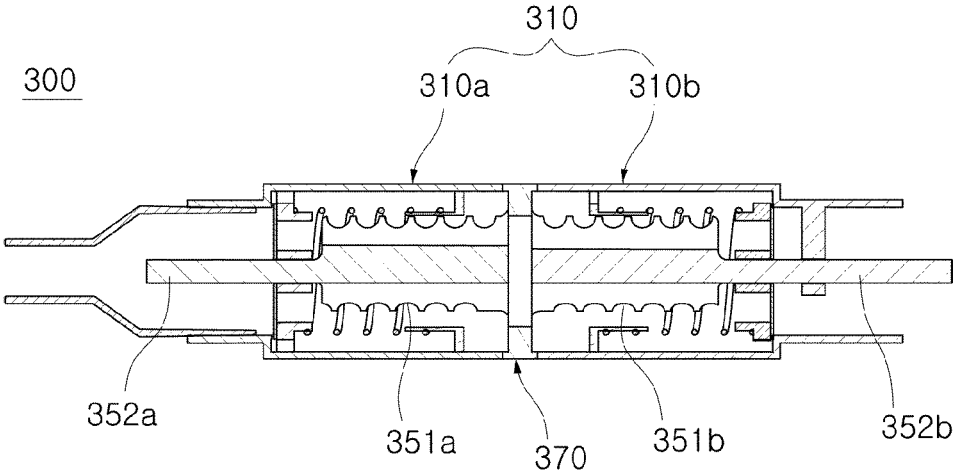
FIG. 11 is a cross-sectional view showing a modified example of the respiratory rehabilitation apparatus according to another embodiment of the present invention when viewed from the side.
Figure 12:
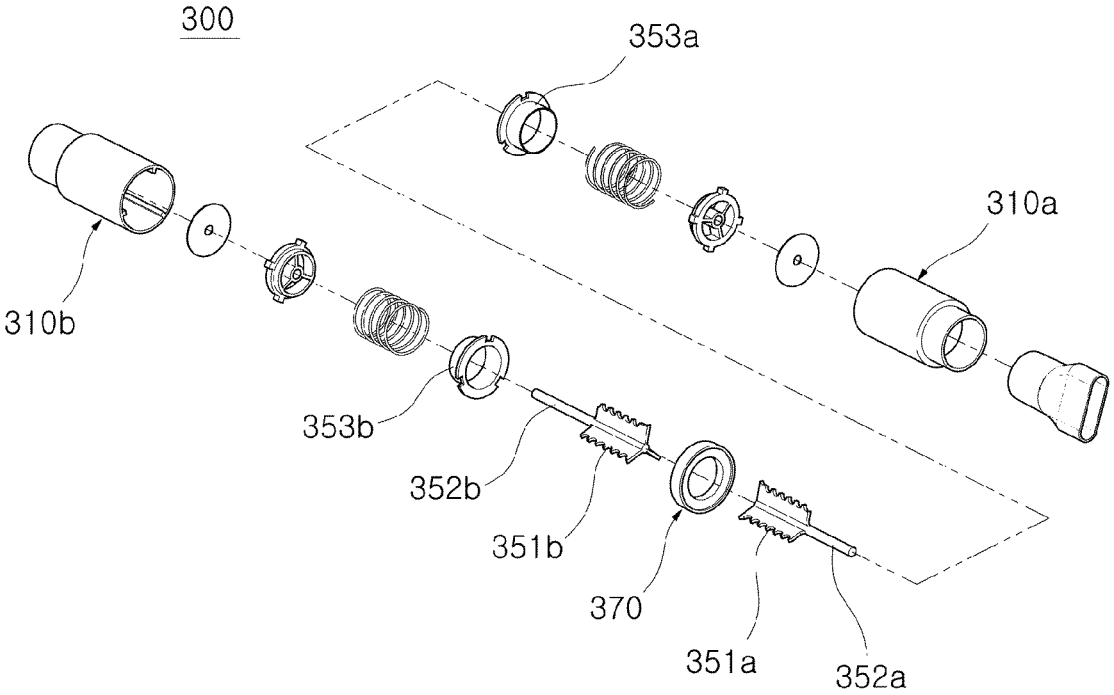
FIG. 12 is an exploded perspective view showing the modified example of the respiratory rehabilitation apparatus according to another embodiment of the present invention.

FIG. 11 is a cross-sectional view showing a modified example of the respiratory rehabilitation apparatus according to another embodiment of the present invention when viewed from the side, and FIG. 12 is an exploded perspective view showing the modified example of the respiratory rehabilitation apparatus according to another embodiment of the present invention. The modified example of another embodiment of the present invention has the same basic configuration as the embodiment described above, except for a housing 310, a first rod body 351*a*, a second rod body 351*b*, and a housing-coupling part 370, and thus a detailed description of the same configuration will be omitted.

As shown in FIGS. 11 and 12, the first rod body 351*a* and the second rod body 351*b* may be disposed separately from each other. In this case, the positions of the stoppers 353*a* and 353*b* may be individually adjusted so that the pressure load generated during exhalation and the pressure load generated during inhalation may be independently varied.

In detail, in the state in which the first rod body 351*a* and the second rod body 351*b* are disposed separately from each other, if the rod extension portion 352*a* is rotated, only the first rod body 351*a* is rotated, and accordingly the position of the first stopper 353*a* may be adjusted. In addition, if the rotation adjustment portion 352*b* is rotated, only the second rod body 351*b* is rotated, and accordingly the position of the second stopper 353*b* may be adjusted. Accordingly, the pressure load generated during exhalation and the pressure load generated during inhalation may be independently varied to a pressure load required by the user, thereby further improving convenience of use.

Here, the housing 310 may be divided into a first housing 310*a* and a second housing 310*b*, in which the first rod body 351*a* and the second rod body 351*b* are disposed, respectively. In addition, a housing-coupling part 370 may be provided such that an end portion of the first housing 310*a* and an end portion of the second housing 310*b*, which face each other, are detachably coupled to opposite sides of the housing-coupling part 370. In some cases, a silicon member may be inserted and disposed between the housing-coupling part 370 and the first housing 310*a* and between the housing-coupling part 370 and the second housing 310*b* in order to secure the coupling therebetween.

As such, since the first housing 310*a* and the second housing 310*b* are detachably coupled to opposite sides of the housing-coupling part 370, the process of assembling or disassembling various components included therein may be facilitated, and convenience of use may be improved.

Since terms, such as "comprising," "including," and "having" mean that one or more corresponding components may exist unless they are specifically described to the contrary, it shall be construed that one or more other components can be included. All of the terminologies containing one or more technical or scientific terminologies have the same meanings that persons skilled in the art understand ordinarily unless they are defined otherwise. A term ordinarily used like that defined by a dictionary shall be construed that it has a meaning equal to that in the context of a related description, and shall not be construed in an ideal or excessively formal meaning unless it is clearly defined in the present specification.

The present invention is not limited to the above-described exemplary embodiments, and, as is apparent from the appended claims, the present invention may be modified by those skilled in the art to which the present invention pertains, and such modification falls within the spirit and scope of the present invention.

INDUSTRIAL APPLICABILITY

The present invention may be applied to the manufacturing industry of a respiratory rehabilitation apparatus.

The invention claimed is:

1. A respiratory rehabilitation apparatus, comprising:

a housing defining an external appearance, the housing being formed to have a hollow shape;

an adjustment rod comprising a housing-coupling part disposed at a center portion in a longitudinal direction of the housing, the housing-coupling part comprising a plurality of through-passages formed therethrough in a longitudinal direction, and a pair of rod body parts provided at opposite sides in the longitudinal direction of the housing-coupling part, the pair of rod body parts comprising screw threads formed in outer circumferences thereof;

a pair of stoppers formed to have a hollow shape so as to be coupled to the outer circumferences of the pair of rod body parts, the pair of stoppers comprising screw threads formed in inner circumferences thereof, the pair of stoppers being configured to selectively adjust respiration pressure;

a pair of pressurization-movement parts comprising protrusions formed at center portions thereof, the protrusions extending outwards in a longitudinal direction, and a plurality of respiration passages formed therethrough, the plurality of respiration passages extending in the longitudinal direction while surrounding the protrusions, the pair of pressurization-movement parts being configured to be pressurized and moved inwards in the longitudinal direction of the housing by respiration pressure during respiration;

a pair of elastic members disposed between the pair of pressurization-movement parts and the pair of stoppers so as to be selectively pressed, the pair of elastic members surrounding outer peripheries of the pair of rod body parts; and a pair of diaphragms comprising a through-hole formed in center portions thereof to allow a respective protrusion of each of the pair of pressurization-movement parts to be inserted thereinto, the pair of diaphragms being disposed to be in close contact with outer sides in the longitudinal direction of the pair of pressurization-movement parts.

2. The respiratory rehabilitation apparatus according to claim 1, wherein the housing is divided into a first housing and a second housing, and wherein the first housing and the second housing are coupled to the housing-coupling part so as to be selectively and individually rotated in a circumferential direction in order to variably adjust a respiration pressure load through the pair of stoppers.

3. The respiratory rehabilitation apparatus according to claim 2, wherein the housing-coupling part comprises a rod-fixing portion formed in a center portion in a radial direction thereof, the rod-fixing portion being formed to have a cross-section that is bent so as to be recessed in the longitudinal direction, and wherein the pair of rod body parts comprise insertion protrusions formed at inner sides in the longitudinal direction thereof, the insertion protrusions being configured to be selectively inserted into or removed from the rod-fixing portion in the longitudinal direction, the insertion protrusions being formed to have a cross-section that is bent so as to match a shape of the rod-fixing portion in order to maintain a fixed state when the first housing and the second housing individually rotate.

4. The respiratory rehabilitation apparatus according to claim 1, wherein the housing comprises a plurality of guide protrusions formed on an inner circumference thereof, the plurality of guide protrusions being arranged at predetermined intervals in a circumferential direction, the plurality of guide protrusions protruding in a radially inward direction, the plurality of guide protrusions extending in the longitudinal direction, and wherein the pair of stoppers comprise recesses formed in outer circumferences thereof to allow the plurality of guide protrusions to be inserted thereinto, the recesses being arranged in a circumferential direction so as to match arrangement intervals of the plurality of guide protrusions, the recesses being recessed in a radially inward direction.

5. The respiratory rehabilitation apparatus according to claim 1, wherein the pair of rod body parts comprise:

rod bodies radially arranged on cylindrical bars in a circumferential direction of the cylindrical bars, the cylindrical bars being disposed in the longitudinal direction, the rod bodies comprising screw threads formed in outer circumferences thereof; and extending latching portions formed at inner sides in the longitudinal direction of the pair of rod body parts, the extending latching portions being arranged at predetermined intervals in a circumferential direction, the extending latching portions protruding and extending in a radial direction so that the pair of elastic members are latched thereby.

6. The respiratory rehabilitation apparatus according to claim 1, wherein the housing comprises stepped portions formed at opposite end portions thereof, the stepped portions being formed to gradually decrease in radius toward the end portions so as to be stepped, and wherein an outer diameter of a rim of each of the pair of pressurization-movement parts is formed so as to match an inner diameter of each of the end portions of the housing so that air flows between an inner circumference of the housing and the rims of the pair of pressurization-movement parts when the pair of pressurization-movement parts are pressurized.

7. The respiratory rehabilitation apparatus according to claim 1, wherein the pair of pressurization-movement parts comprises latching-fixing portions formed at rims thereof, the latching-fixing portions being arranged at predetermined intervals in a circumferential direction, the latching-fixing portions extending in a radially outward direction so as to be latched by stepped portions.

8. The respiratory rehabilitation apparatus according to claim 1, wherein an outer diameter of each of the pair of diaphragms is formed so as to match an outer diameter of a rim of each of the pair of pressurization-movement parts so as to cover outer sides in the longitudinal direction of the plurality of respiration passages.

9. The respiratory rehabilitation apparatus according to claim 1, further comprising a mouthpiece coupled to any one of opposite end portions of the housing.

10. The respiratory rehabilitation apparatus according to claim 1, further comprising:

a piece-coupling part, an inner end portion in a longitudinal direction of the piece-coupling part being coupled to an edge of one end portion of the housing-coupling part; and a mouthpiece coupled to an outer end portion in the longitudinal direction of the piece-coupling part.

* * * * *